United States Patent [19]

Justus

[11] Patent Number: 4,752,217

[45] Date of Patent: Jun. 21, 1988

[54] WIRE COATING OVEN INCLUDING WIRE COOLING APPARATUS

[75] Inventor: Paul E. Justus, Fort Wayne, Ind.

[73] Assignee: Essex Group, Inc., Fort Wayne, Ind.

[21] Appl. No.: 90,492

[22] Filed: Aug. 28, 1987

[51] Int. Cl.[4] ..... F27D 15/02; F27B 9/28

[52] U.S. Cl. ..... 432/77; 432/59; 432/82; 432/72

[58] Field of Search ..... 432/59, 8, 71, 72, 81–83, 432/77, 78

[56] References Cited

U.S. PATENT DOCUMENTS

| | | | |
|---|---|---|---|
| 3,183,605 | 5/1965 | Argue et al. | 34/68 |
| 3,351,329 | 11/1967 | Thomas | 263/3 |
| 4,249,895 | 2/1981 | Mantegani | 432/78 |
| 4,285,669 | 8/1981 | Walchhutter | 432/176 |
| 4,303,387 | 12/1981 | Burke et al. | 432/72 |
| 4,436,292 | 3/1984 | Pfannschmidt | 432/59 |
| 4,448,578 | 5/1984 | Brunet et al. | 432/72 |
| 4,568,274 | 2/1986 | Imose et al. | 432/82 |
| 4,591,336 | 5/1986 | Konczalski | 432/59 |
| 4,595,357 | 6/1986 | Sato et al. | 432/8 |
| 4,642,049 | 2/1987 | Louis | 432/72 |
| 4,664,172 | 5/1987 | Takayanagi | 164/34 |
| 4,678,433 | 7/1987 | Ellison | 432/59 |

*Primary Examiner*—Henry C. Yuen
*Attorney, Agent, or Firm*—William J. Sapone

[57] ABSTRACT

A wire coating oven (2) is disclosed which includes a wire cooling apparatus (1) for cooling a wire (3) passing therethrough, while minimizing gaseous emissions. The cooling apparatus includes a wire cooling passage (10) having a wire entrance end (13) adjacent the oven and a wire exit end open to the atmosphere, with the wire cooling passage defined by a first wall (11) which surrounds the wire passing therethrough. A hot gas passage (15) is defined by a spacing between the first wall and a second wall (14) disposed adjacent thereto with hot gas entering the passage at about the wire exit end and exiting at the oven end. The first wall includes an outwardly tapered surface (19) near the wire entrance end for forming a venturi with the second wall, whereby a hot gas passing therebetween creates a negative pressure within the wire passage, drawing cool air (20) into the wire passage, cooling the wire and drawing any vaporous emissions into the oven. Utilizing the above described apparatus has resulted in substantial reductions in emissions while minimizing snagging problems during wire string-up.

4 Claims, 4 Drawing Sheets

WIRE COATING OVEN INCLUDING WIRE COOLING APPARATUS

DESCRIPTION

1. Technical Field

This invention relates to wire coating ovens which include wire cooling apparatus for air cooling a coated wire drawn therethrough.

2. Background Art

Wires are generally coated with such materials as enamels or resins to provide insulation and resistance to damage during handling. Most such wires include a mix of coatings to provide enhanced properties. For example, a typical wire might include one or more polyester enamel base coats and one or more amide-imide enamel top coats. These coating materials are generally spray, metering die or roller applied while suspended in a solvent or dispersing agent. After each application, the wires are generally passed through a wire coating oven containing a first evaporation zone for heating the wire to drive off the solvent or dispering agent, and a second cure zone for polymerizing or curing the coating material. To achieve the proper coating thickness requires the serial addition, evaporation, curing, cooling and readdition of coating materials.

After passing through a single application, evaporation and curing step, hereinafter referred to as a "pass", the wire travels through a wire cooling apparatus. One such apparatus is shown in U.S. Pat. No. 4,303,387 to Burke et al, which utilizes a blower to force cool air over the wire. In U.S. Pat. No. 3,351,329 to Thomas, a wire cooler is disclosed which includes restrictive pressure plate means which cooperate with grid means and adjustable panel means to control a forced cooling air flow such that venturi action occurs at the wire entrance end of the wire cooler to reduce the pressure below the restrictive means to a level below that of the external environment of the wire cooler, drawing air in at the wire entrance, and preventing the pressurized cooling air from spilling over into the curing zone of the oven. The forced cooling air first flows over the wire passage wall, providing a relatively cool surface, and then is injected into the wire passage, traveling cocurrently with the wire to the wire exit end of the cooler.

Several problems have been encountered in using an apparatus such as that proposed by Thomas. For example, the control means utilized by Thomas to adjust the venturi nozzle area provides a "necked down" passage which creates problems during the string-up of the oven. The restrictive means, adjustable plate means, grid means and bolts included within the wire passage create obstacles which may cause snagging to occur with frequent wire breakage.

In addition, a hot wire exiting the cure zone of the oven usually emits hot vaporous coating material, hereafter referred to as "afterbake", which may condense on the relatively cool sidewalls of the wire cooler, causing a build-up which eventually reduces the wire travel path to the point where it contacts the wire passing therethrough, contaminating or physically damaging the wire. The venturi surfaces, described relative to Thomas above, are particularly susceptable sites for afterbake build-up to occur. Even if the afterbake is not condensed on the wire passage sidewalls or venturi apparatus, this vapor and any other fumes emitted by the hot wire as it undergoes cooling are discharged with the cooling air to the environment. This is very undesirable as many of these emissions are considered at best a nuisance. Consequently, there is a continued search in the art for wire coating ovens which include wire cooling apparatus which provide containment of fumes generated within the oven while reducing snagging and wire contamination problems.

DISCLOSURE OF THE INVENTION

According to the present invention, a wire coating oven is disclosed which includes means for drawing a wire therethrough, means for coating the wire, means for heating the coated wire, means for curing the coated wire and means for cooling the coated wire, with the means for cooling the wire comprising a wire cooling passage having a wire entrance end, adjacent the curing means, and a wire exit end, with the wire cooling passage defined by first wall means which substantially surrounds the wire passing therethrough. Second wall means substantially surrounds the first wall means, with the spacing between the first wall and the second wall defining a hot gas passage therebetween. Hot gas enters the hot gas passage through an opening at about the wire exit end, passing over the first wall means, and exits at the wire entrance end, providing the hot gas required in the cure zone of the oven. The first wall means also includes an outwardly tapered surface at about the wire entrance end for forming a venturi with the second wall, whereby the hot gas passing therebetween creates a negative pressure within the wire cooling passage, drawing ambient air into the wire cooling passage at the wire exit end.

The hot gas passing over the first wall means maintains the wall at a high temperature to prevent afterbake from condensing thereon, while utilizing an outwardly tapered surface eliminates obstructions, providing snag-free string-up during start up of the wire coating oven. In addition, by providing a venturi at the wire entrance end, the cool air is drawn into the oven, countercourent to the wire travel, preventing noxious fumes from escaping into the environment. The combined stream provides the curing gas for the cure zone of the oven. Utilizing such an arrangement substantially reduces string up problems while reducing emmissions, eliminating the need for cooling air blowers or other forced cooling arrangements.

BEST MODE FOR CARRYING OUT THE INVENTION

Figure 1:
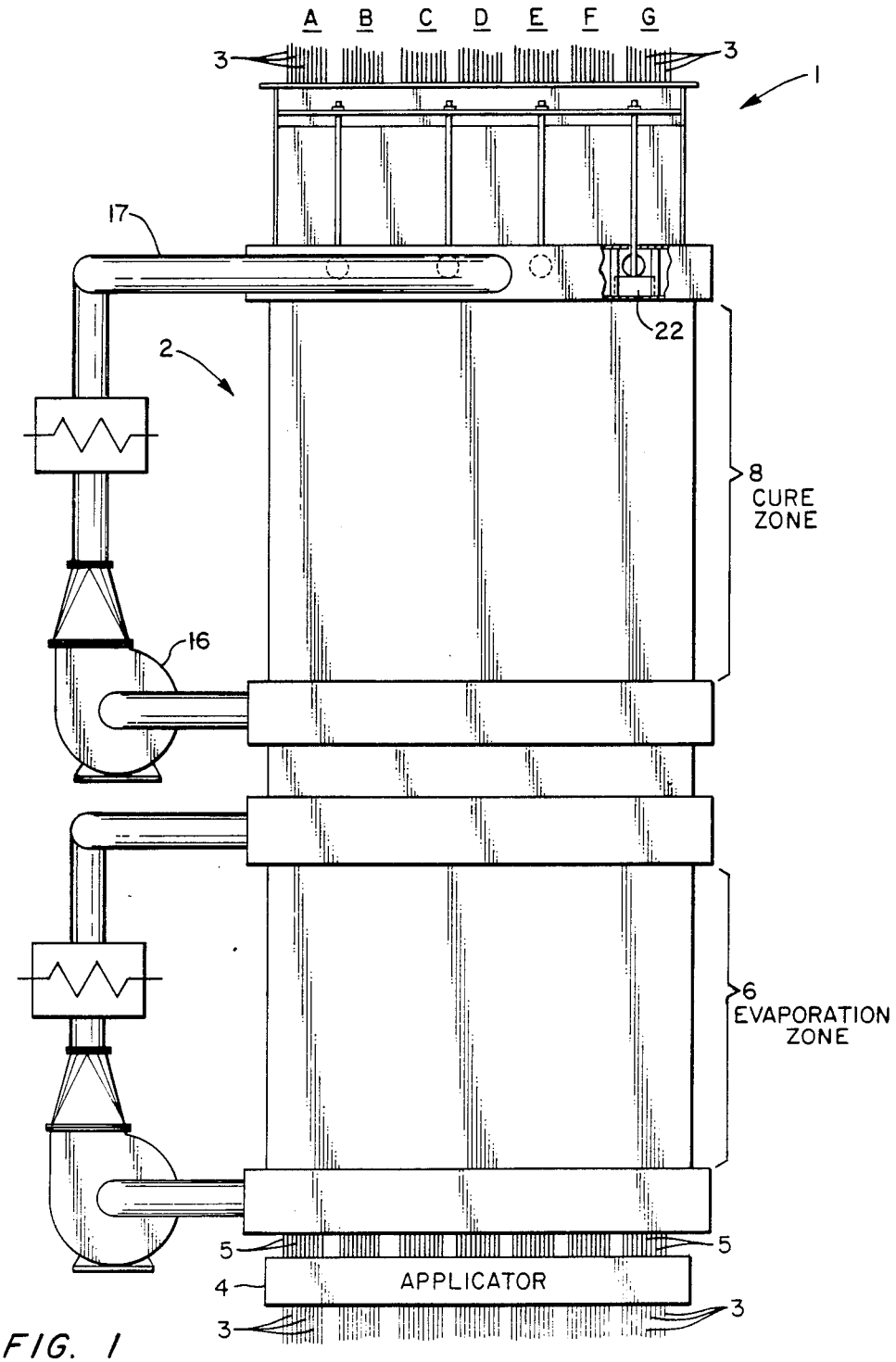
FIG. 1 is a side view of a wire cooling apparatus utilized on a multi-application wire coating oven.

Refering to FIG. 1, a wire cooling apparatus 1 is shown on a multi-pass wire coating oven 2. For illustrative purposes, 10 wires 3 are simultaneously being drawn through the oven 2 in one pass, with five base coats (A–E) and two top coats (F,G) being applied. While such an arrangement is illustrative, it will be understood by one skilled in the art that one or more wires receiving one or more coatings will benefit from this invention. Typical wires may be aluminum or copper, of any desired diameter, such as from AWG 12 (0.0808" dia.) through AWG 24 (0.0201" dia.). In addition to such typical solid core metal wires, the term "wire" is hereinafter defined as including solid core plastic or ceramic materials as well as metal, plastic or ceramic tubing. Typical enamel insulation types which may be utilized with this invention include, but are not limited to, types GP 200, MR 200, NYHTERM, and FORMVAR.

Figure 2:
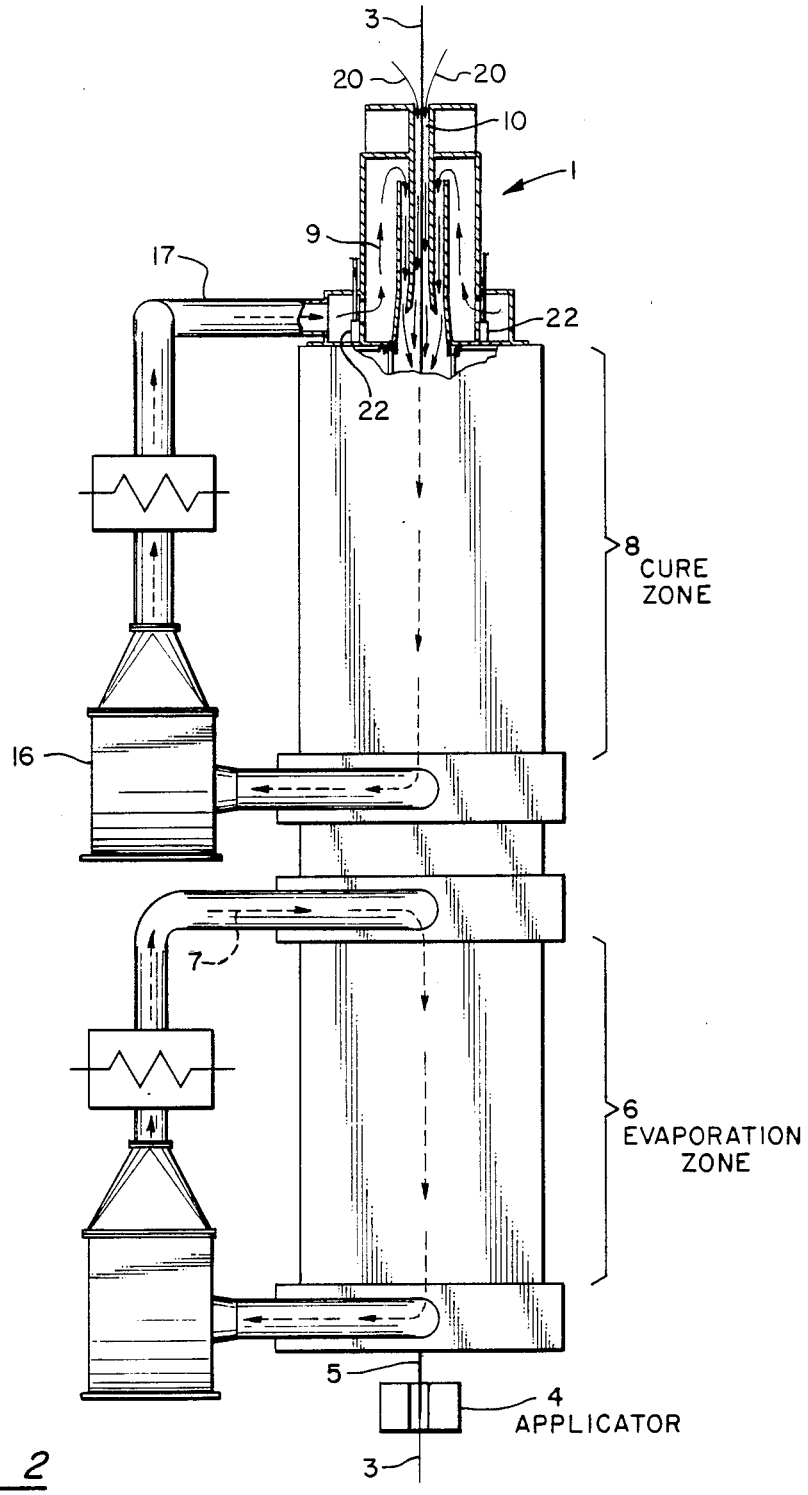
FIG. 2 is a front view of a typical wire coating oven including an evaporation zone, cure zone and wire cooling apparatus.

Referring to FIG. 2, a wire 3 is drawn through an applicator 4 where a coating 5 is applied. A single wire is disscussed for ease in illustration and in no way reduces the scope of the present invention. The coated wire 3 enters an evaporation zone 6 where any solvents are driven off by a hot gas, illustrated by arrow 7, such as air at a temperature of about 900° F., travelling at about 800 ft/min, which flows countercurrent to the wire's movement. The gas is usually recirculated through filters or a burner to remove the solvents and reheat the stream. The wire 3 then enters a cure zone 8 where the now thickened coating is polymerized or cured by a second hot gas 9, such as air at a temperature of about 1000° F., travelling at about 2000 ft/min, which flows countercourent to the wire movement, with the gas again recirculated through filters or a burner to remove any remaining solvents or afterbake. A wire cooling apparatus 1 is disposed on top of the oven 2 for cooling the wire 3 after leaving the cure zone 8.

Figure 3:
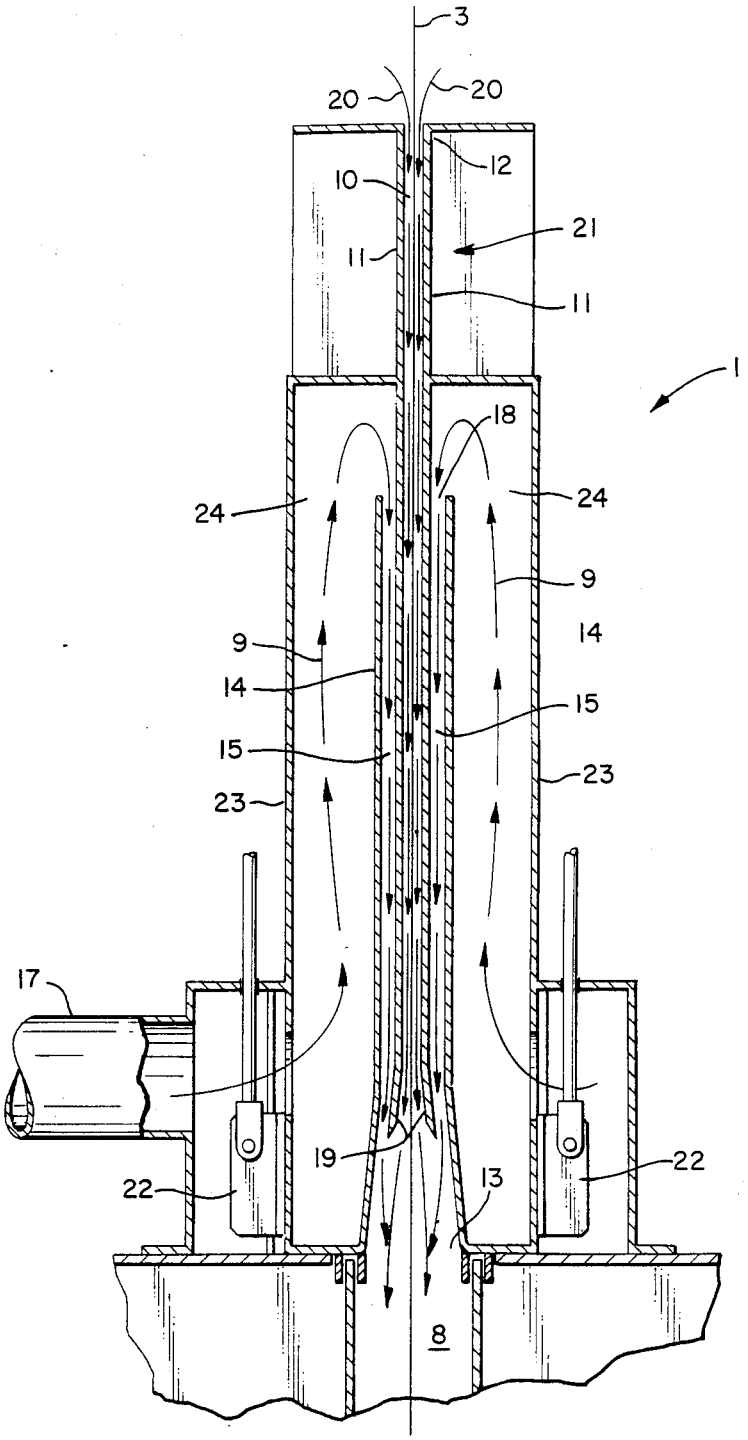
FIG. 3 is a sectional view of the wire cooling apparatus of the present invention.
Figure 4:
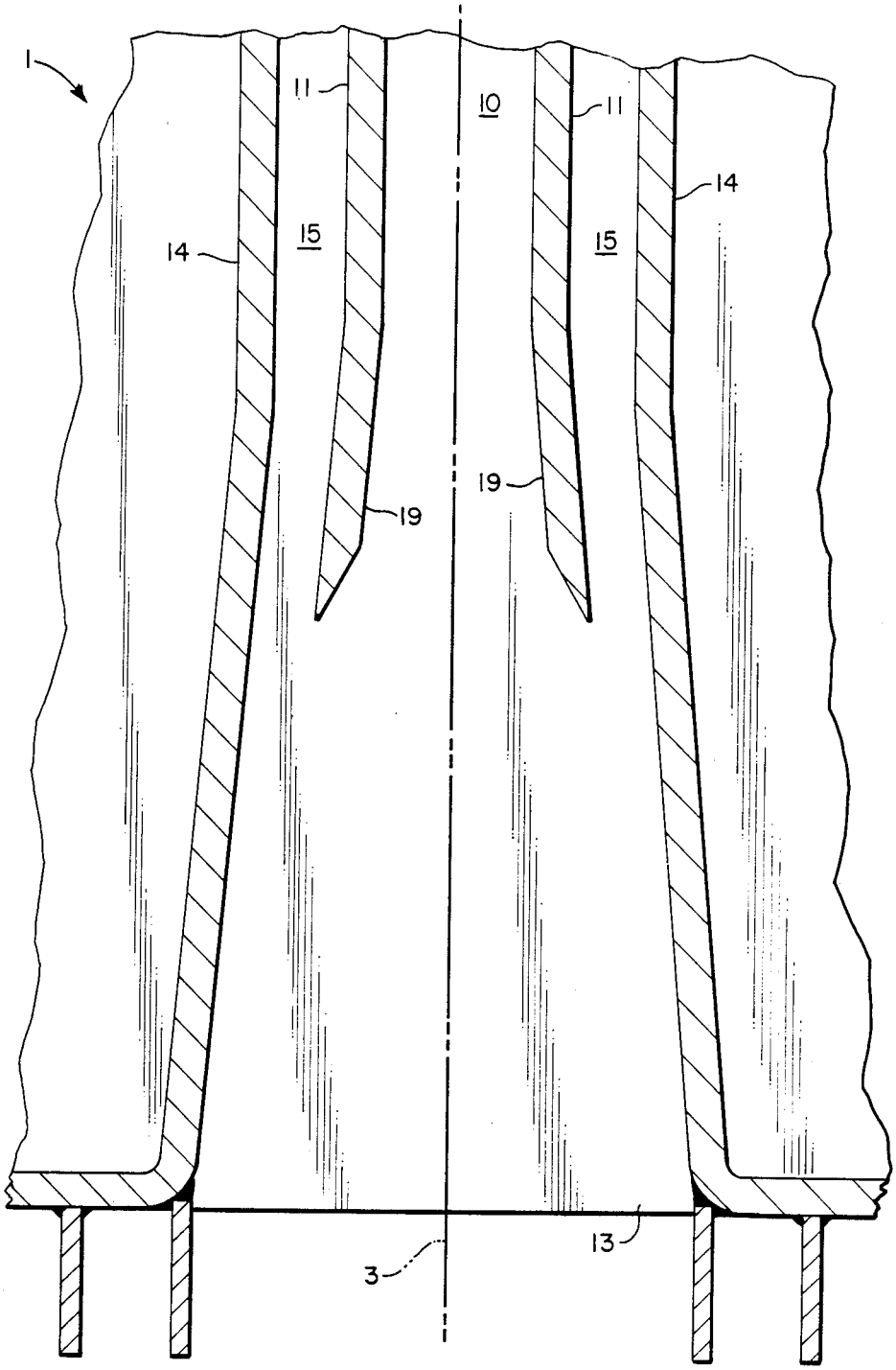
FIG. 4 is an enlarged view taken along line 4—4 of FIG. 3.

Referring to FIG. 3, the wire cooling apparatus 1, disposed adjacent to the cure zone, is shown in section. A wire passage 10 is defined by a first wall 11, with the wall 11 extending from a wire exit end 12 to substancially a wire entrance end 13. "Wall" is hereafter defined as an enclosure surrounding an article, with the shape being a matter of choice for example, the first wall may be round or rectangular, forming an enclosure around one or more wires. A second wall 14 surrounds a lower portion of the first wall, with the spacing between the first wall and the second wall defining a hot gas passage 15. A hot gas blower 16 provides the second hot gas 9 to the hot gas passage 15 through a duct 17. This hot gas may comprise combustion gas or steam heated air. The hot gas enters the passage 15 through an opening 18 near the wire exit end 12, and passes over the first wall, maintaining the adjacent first wall above the dew point of any vapors emitted by the wire passing therethrough. At the wire entrance end 13, the first wall includes an outwardly tapered surface 19, which reduces the spacing between the first and second walls. This is best illustrated in FIG. 4. Such a configuration produces a venturi effect as the hot gas exits therebetween, creating a negative pressure at the wire entrance end 13 which draws cool ambient air 20 through the wire passage 10. The cool air, passing countercourrent to the traveling wire, cools the wire while also drawing any vapors emitted by the wire back into the oven. The cool air then mixes with the hot gas 9 and enters the cure zone 8 of the oven.

As shown, the second wall surrounds only a lower portion of the first wall, providing an unsurrounded extention of the first wall which acts as an aftercooler 21, providing a relatively cooler zone in the wire passage. In essence, a gradient is established across the wire cooler, with the relatively warmer section allowing afterbake emission without condensation, and the relatively cooler section further reducing the wire temperature to the desired value. Since the afterbake is drawn into the oven continuously, there is no danger of buildup in the aftercooler with wire contamination. Of course, it may be desirable to surround the entire length of the first wall.

Refering again to FIG. 1, dampers 22 are shown in a sidewall 23 of the wire cooling apparatus 1. These dampers 22, which may be either fixed in preset positions or adjustable through manual or automatic control means, are provided in ducts 24 (best seen in FIG. 2) for volumetric control of the hot gas stream. Since the suction effect is created by the hot gas stream, such a damper may provide optimum control of the suction and thereby limit dilution of the hot gas stream while optimizing the wire exit temperature. While dampers and ducts are shown, it will be understood by those skilled in the art that any or no control means may be utilized with the present invention.

Utilizing the venturi design of the present invention prevents fumes or emissions from exiting the wire coating oven. As the wire passes through the wire passage, the cool air draws off any vapor emissions, which are combined with the hot oven air and destroyed within the oven. In addition, the hot air which surround the first wall maintains the wall temperature above the condensation temperature, preventing any afterbake emissions from narrowing the passage wall and causing wire contamination. In addition, by utilizing an outwardly tapered wire entrance end, snagging during string-up has been avoided and startup difficulties minimized. Since the wire cooling apparatus uses the curing zone gas stream to generate the venturi effect, forced cooling air blowers are eliminated, with a consequent decrease in equipment and maintanence expenses.

While the above apparatus have been shown and described in relation to a wire coating oven utilizing a particular wire coating material and apparatus, it will be understood by those skilled in the art that any wire coating oven could utilize the present invention.

I claim:

1. In a wire coating oven including means for drawing a wire therethrough, means for coating the wire, means for heating the coated wire, means for curing the coated wire, and means for cooling the coated wire, an improvement characterized by the means for cooling the wire comprising;

a wire cooling passage having a wire entrance end substantially adjacent the curing means and a wire exit end open to the atmosphere, the passage defined by first wall means which substantially surrounds the wire passage;

a hot gas passage defined by the spacing between the first wall means and a second wall means disposed adjacent thereto, the second wall means extending from the wire entrance end to about the wire exit end, with an opening provided at about the wire exit end for admitting a hot gas to the hot gas passage, the hot gas passable over the first wall means, maintaining the first wall means at a high temperature and then entering the curing means, the first wall means including an outwardly tapered surface at about the wire entrance end for forming a venturi type opening with respect to the second wall means, whereby the hot gas passing therebetween creates a negative pressure within the wire cooling passage, drawing cool air therethrough, cooling the wire while drawing emissions into the oven.

2. The wire coating oven of claim 1 wherein the first wall means extend beyond the second wall means, providing an aftercooler which has an unheated wall portion.

3. The wire coating oven of claim 1 further characterized by control means for varying the quantity of cooling air admitted to the wire passage.

4. The wire coating oven of claim 3 wherein the control means comprise a damper valve, disposed in a hot gas duct leading to the hot gas passage.

* * * * *